United States Patent [19]

Versteeg

[11] Patent Number: 5,022,543

[45] Date of Patent: Jun. 11, 1991

[54] POSITIONING GEAR FOR MOVING A LOAD SUSPENDED BY AT LEAST ONE CABLE OF A LIFTING SYSTEM IN THE VERTICAL DIRECTION

[75] Inventor: Gijsbert Versteeg, Nunspeet, Netherlands

[73] Assignee: Vervako B.V., Heusden, Netherlands

[21] Appl. No.: 248,381

[22] Filed: Sep. 23, 1988

[30] Foreign Application Priority Data

Sep. 24, 1987 [NL] Netherlands ..... 8702283

[51] Int. Cl.[5] ..... B66C 13/40; B66C 23/79; B66C 7/00

[52] U.S. Cl. ..... 212/271; 212/160; 212/225; 212/195; 212/71; 212/77

[58] Field of Search ..... 212/215, 213, 220–221, 212/225, 242, 250, 251, 257, 260; 91/6, 26, 31, 391 R

[56] References Cited

U.S. PATENT DOCUMENTS

| | | | |
|---|---|---|---|
| 101,681 | 4/1870 | Towle | 212/256 |
| 2,939,431 | 6/1960 | Bottje et al. | 91/6 X |
| 2,949,894 | 8/1960 | Hewitt et al. . | |
| 3,635,020 | 1/1972 | Mahlmann | 91/6 X |
| 3,894,476 | 7/1975 | Cobb . | |
| 4,215,844 | 8/1980 | Bowen | 91/31 X |
| 4,401,009 | 8/1983 | Zeuner et al. | 91/31 X |
| 4,646,517 | 3/1987 | Wright | 91/6 X |

FOREIGN PATENT DOCUMENTS

| | | | |
|---|---|---|---|
| 2335407 | 1/1975 | Fed. Rep. of Germany . | |
| 2604046 | 8/1976 | Fed. Rep. of Germany | 212/250 |
| 3418923 | 11/1985 | Fed. Rep. of Germany . | |
| 580944 | 11/1924 | France . | |
| 2512795 | 3/1983 | France . | |
| 1023177 | 3/1966 | United Kingdom . | |

*Primary Examiner*—Joseph F. Peters, Jr.
*Assistant Examiner*—R. B. Johnson
*Attorney, Agent, or Firm*—Michael N. Meller

[57] ABSTRACT

Positioning device to be incorporated as a controllable coupling element between a load and the cable of a hoisting apparatus. The element includes a hydraulic cylinder connected to a hydro-pneumatic transformer and to a hydro-pneumatic reservoir. The transformer is connected to a source of pressurized gas through a first valve, a second valve being provided in the line from the cylinder to the reservoir. The cylinder, the transformer, the pressurized gas source, the reservoir and both valves are mounted in a common frame, both valves being operable from a distance.

2 Claims, 4 Drawing Sheets

POSITIONING GEAR FOR MOVING A LOAD SUSPENDED BY AT LEAST ONE CABLE OF A LIFTING SYSTEM IN THE VERTICAL DIRECTION

BACKGROUND OF THE INVENTION

This invention relates to a positioning gear for moving a load suspended by at least one cable of a lifting system in the vertical direction.

In building large structures it is generally necessary to position large, complex and heavy members of the total structure by means of a hoisting crane, after which these structural members can be installed. In this process it is up to the crane driver to position the member as well as possible. However, since the crane driver is usually at a great height above the installation level, it is in practice not feasible for him to determine the correct position, in particular the correct height, of the member with respect to the structure. He usually receives, therefore, directions from an assistant at installation level, and generally the positioning of the structural member at installation level is carried out using manual force. This is time-consuming and requires manpower, and is therefore expensive.

SUMMARY OF THE INVENTION

It is now an object of the invention to permit an assistant at installation level to carry out all the positioning operations as soon as the crane driver has brought the member approximately to its intended position.

Another object is to provide a positioning gear in the form of an independently controllable unit for accurately positioning a load comprising an energy source, so that the positioning gear is able to work for a certain period without supply of energy from outside and which gear can be used at any location.

Still another object of the invention is to provide a positioning gear only requiring energy for moving a load upwardly, the moving of the load downwardly being effected by only the load.

This object is achieved by a positioning gear of the said type, whereby said gear comprises a controllable positioning element provided with a first attaching device for joining the element to a first cable section and a second attaching device for joining the element to a second cable section, following the first cable section, which can be joined to the load, said positioning element being able to vary the distance between said first and second attaching devices, said positioning element forming one movable assembly with an independent energy source or energy sources for operating the positioning element in a manner such that, after the positioning element has been joined to a cable, the entire assembly can be moved together with a load to be lifted or set down.

Such a gear makes it possible for an assistant at installation level to be able to determine relatively rapidly and accurately the position of the load by controlling the positioning gear.

This offers the great advantage that, in places where there is no room for placing trucks, cranes, and the like, which situation often occurs in towns with dense building and heavy traffic which must not be interrupted by closure, a load can nevertheless be set down in a simple and rapid manner at the desired position, which results in considerable savings in view of the costs of hiring a crane.

An independent energy source offers the great advantage that it is possible to work without making use of the normal electricity supplies which are often not directly available at such sites, as a result of which the employment of special electricity cables, which can easily be damaged, would be compulsory. The same problems arise if it is necessary to employ a supply line for supplying gaseous or liquid pressure medium, such as compressed air.

This construction also has the advantage that if the energy source is rechargeable, it can be kept small, and the recharging unit can be set down in the vicinity.

Advantageously, the positioning element comprises a single acting controllable working pressure medium cylinder with which a load can be set down in a simple manner at a desired position. According to a very advantageous embodiment, the working pressure medium cylinder together with a supply source of working pressure medium in a supply source of incremental pressure medium with the associated connecting lines forms one assembly which can be suspended via the working pressure medium cylinder in a cable.

In this case, the risk of the connecting lines being damaged is limited to a minimum.

In this case, the operating means for the entire assembly is expediently constructed as mechanically operable operating means such as with a traction cord.

The invention also relates to a method for placing a load at a desired position using a positioning gear according to the invention.

Other claims and many of the attendant advantages will be more readily appreciated as the same becomes better understood by reference to the following detailed description and considered in connection with the accompanying drawings in which like reference symbols designate like parts without the figures.

DESCRIPTION OF PREFERRED EMBODIMENT

Figure 1:
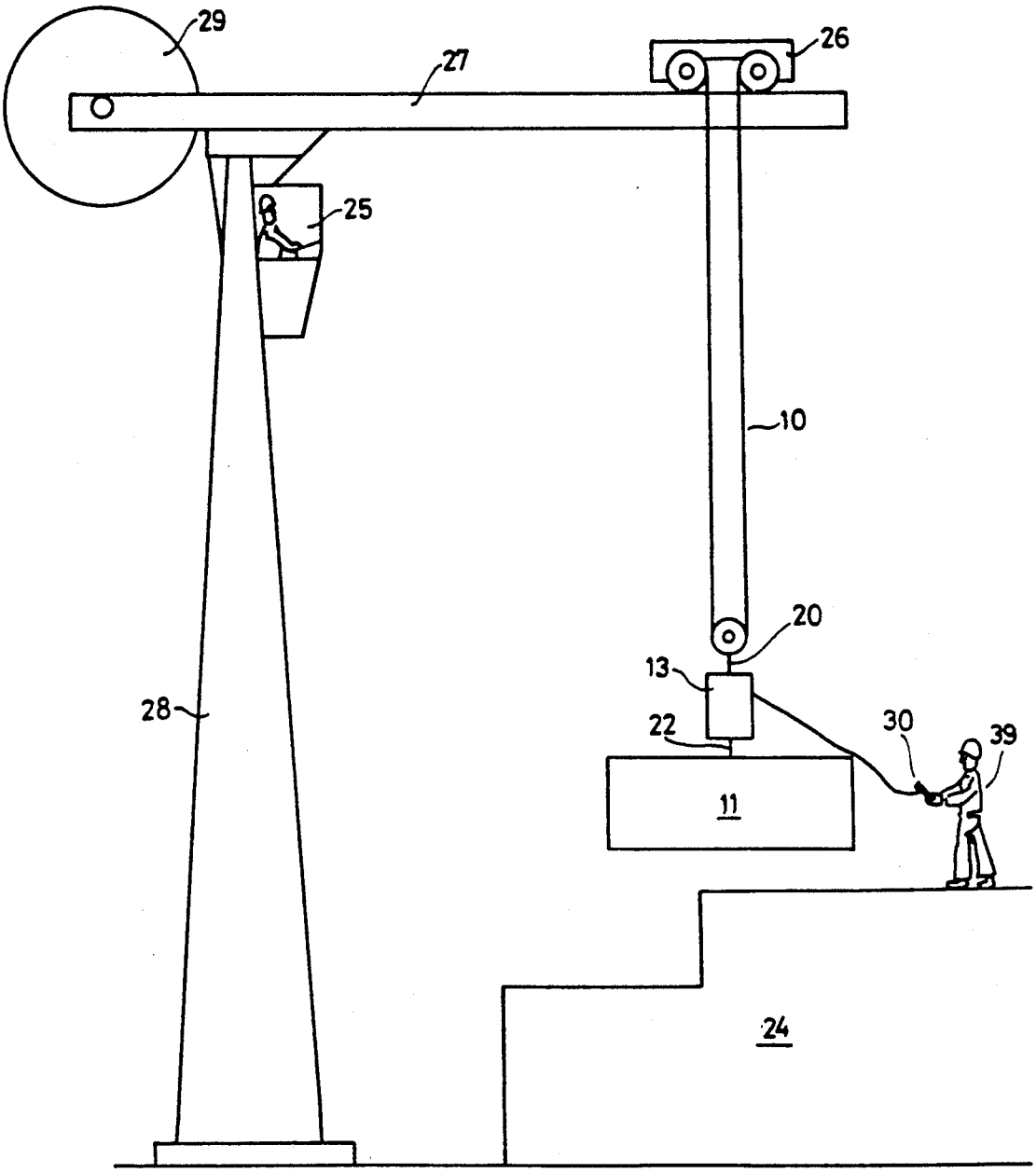
FIG. 1 shows diagrammatically a hoisting crane with the positioning gear according to the invention.

FIG. 1 shows a hoisting crane 28 having a crane jib 27 . Along the crane jib runs a travelling trolley 26 supporting a load 11 via a hoisting cable 10, a positioning gear 13 and cable sections 20 and 22. The force due to the weight of the load is compensated for by a counter-weight 29. The travelling trolley 26 and the hoisting cable 10 are operated by a crane driver 25 whose position is such that he can have a general overview of the positioning of the load. 24 shows a structure in which the load 11 is to be accurately positioned.

The crane drive 25 brings the load 11 approximately to its intended position. Then an operator 39 operates the positioning gear 13 by means of control devices 30 in a manner such that the load 11 is brought precisely to its position in the structure 24.

Figure 2:
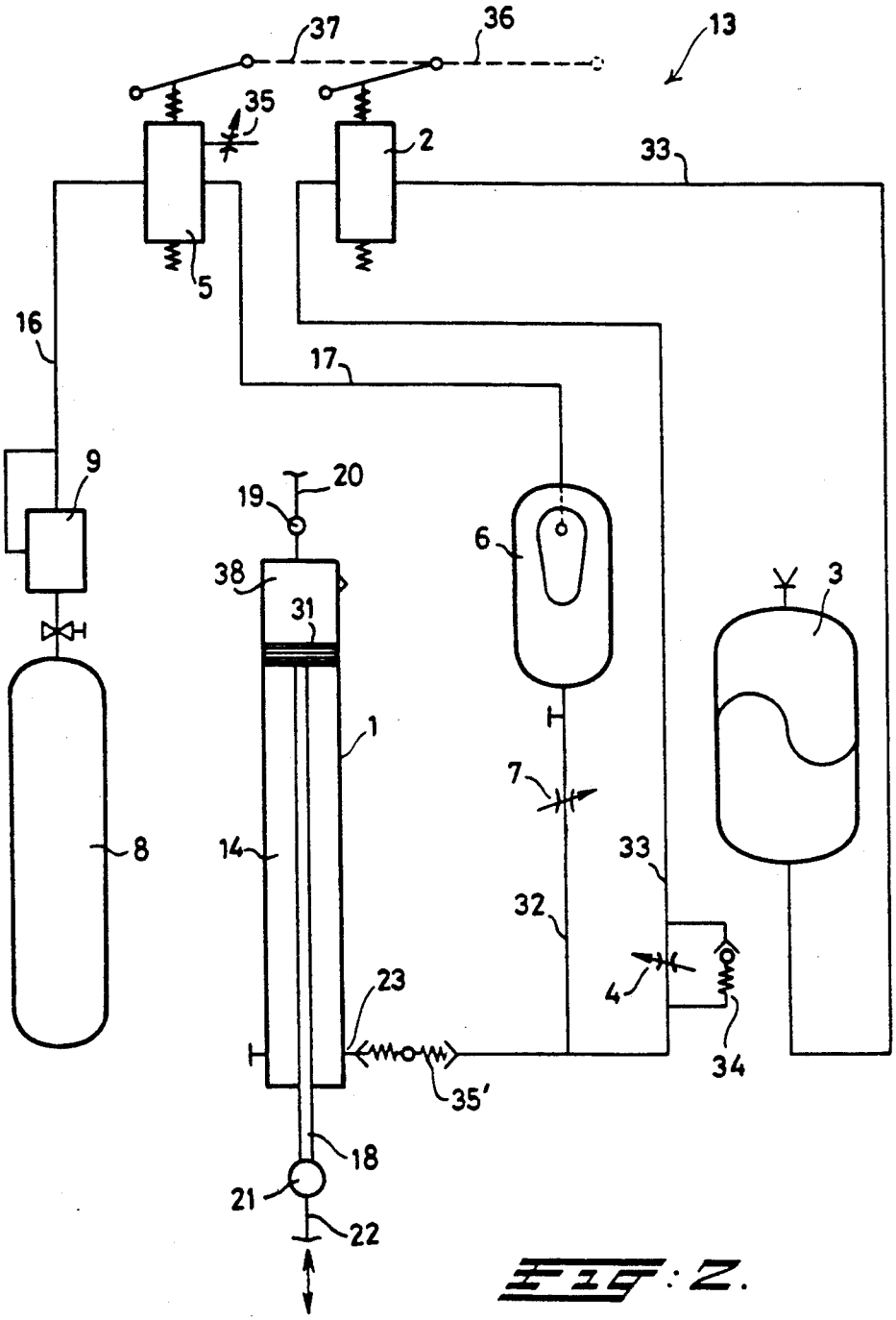
FIG. 2 shows diagrammatically an a large scale an embodiment of the positioning gear shown in FIG. 1.

FIG. 2 shows diagrammatically a preferred embodiment of lifting and positioning gear according to the invention consists of a hydraulic cylinder.

This cylinder comprises a piston 31 with a rod 18. The cylinder 1 has an opening 23 for the supply and discharge of hydraulic working pressure fluid in the space 14; because a simple-acting hydraulic cylinder 1 is involved in this case, the supply and discharge are combined in one line 32. Also arranged in line 32 is a security valve 35' which operates in two directions to prevent the flow velocity of the fluid working pressure medium from being too high.

The line 32 leads to a pressure transformer 6, the pneumatic side of which is connected through a conduit 17, a valve 5 and a further conduit 16 to an energy supply source 8 of supplementary pressure medium, in the present embodiment a reservoir filled with gas under pressure, for example, a gas cylinder.

The line 33 leads to a supply reservoir 3 for working pressure fluid in the present exemplary embodiment a hydraulic-pneumatic oil reservoir of a conventional type.

Downstream of the energy supply source 8 for pressurized gas there is a reducing valve 9 which lowers the pressure of the gas from the supply source 8 to a usable level. Downstream of said reducing valve 9 there is a manually operable valve 5, controlled, for example, by a cord 37. The pressure transformer 6 of a conventional type converts the gas pressure from the source 8 into the pressure on the liquid working pressure medium with which the hydraulic cylinder 1 can be operated. The flow rate of the oil in the line 32 is determined by means of a rate regulating valve 7 which is preferably set beforehand. Although this may also be made controllable, it is preferable to set it beforehand in order to limit the number of operations performed by the operator in positioning the load to a minimum.

Downstream of the oil reservoir or accumulator 3 in the line 33 there is a valve 2 which can be used to allow or interrupt the flow of oil in the line 33. Between the valve 2 and the hydraulic cylinder 1 there is a rate controlling valve 4 by means of which the flow rate of oil in the line 33 can be determined. Connected in parallel with valve 4 is a spring-loaded non-return valve 34 being oriented in such a manner that working pressure medium or oil can only flow through it in the direction of the hydraulic cylinder 1. Said nonreturn valve 34 is useful in order to be able to feed oil rapidly into the cylinder 1 (raising of unloaded piston 31 after the load 11 has been put down) since the flow rate would otherwise only be determined by valve 4. Preferably, the valve 4 is set beforehand for the same reasons as have been mentioned for valve 7. Valve 2 is expediently operated by a cord 36, in which case, to fix the operations for opening and closing the valves, said cord 36 may be connected to cord 37.

A cable section 20 is attached via the device 19 to the housing of the cylinder 1, while a cable section 22 is attached to a device 21 mounted on the connecting rod 18 of piston 31. In the present embodiment, the cable section 20 is attached to the hoisting cable 10 of the crane 28 and the cable section 22 may be attached to the load 11.

The cylinder 1, the pressure transformer 6, the accumulator 3 and the energy supply source 8 and associated lines, and also shut-off valves 2 and 5 are expediently mounted on a frame thus forming a unit so that by incorporating cylinder 1 in the hoisting cable 10 all the other parts are also suspended by means of that frame. As a result of this, the risk of damage to any member when the gear according to the invention is being used is virtually eliminated.

The gear operates as follows.

In the initial state, the valve 2 is open and the piston 31 is in its highest position under the influence of the hydraulic pressure from the accumulator 3. A load 11 is attached to the cable section 22 which is jointed to the piston rod 18. When the hoisting is started, the outward stroke of the piston 31 with connecting rod 18 will take place under the influence of the weight of the load 11. It should be noted that the space 38 above piston 31 is not connected with any pressure fluid. Thus the working pressure cylinder 1 is only single acting. During this first phase of the hoisting and the lowering of the piston 31, a flow of oil takes place from the cylinder 1 towards the oil reservoir 3; the flow rate (and consequently the speed of movement of the load) is set in advance or controlled by means of the rate regulating valve 4. The flow of the oil to the reservoir 3 is stopped by closing the valve 2.

The load, which is not yet lifted in the initial stage, can now be raised by the crane 28 and brought near its intended position in the structure 24. Hereafter the intake stroke of the piston 31 with connecting rod 18 will take place under the influence of the pneumatic pressure from the gas reservoir 8. The valve 5 is opened, which produces a flow of gas under pressure to the pressure transformer 6 where the gas pressure is transmitted to the oil which will flow into the cylinder 1, as a result of which the piston 31 plus the load is moved upwards. This movement is stopped by closing the valve 5.

After the load has been positioned at the desired place, and the load is no longer attached to the cable section 22, the intake stroke of the piston 31 with connecting rod 18 is effected by opening the valve 2 and consequently bringing about the connection between the oil reservoir 3 and the cylinder 1. Due to the pneumatic pressure in the reservoir 3, oil flows from oil reservoir 3 to the cylinder 1, as a result of which the unloaded piston 31 is forced upwards.

Thereafter a new load may then be attached again to the cable section 22 and the lifting and positioning gear is again ready for use.

The operating devices described above (the valves 2 and 5, the rate regulating valves 4 and 7) are connected in a known manner to control devices by means of which the operator is able to operate the lifting and positioning gear. Preference is given to mechanical operation of the valves 2 and 5, while the rate regulating valves are expediently set beforehand and are not regulated during the operation of the gear.

Figure 3:
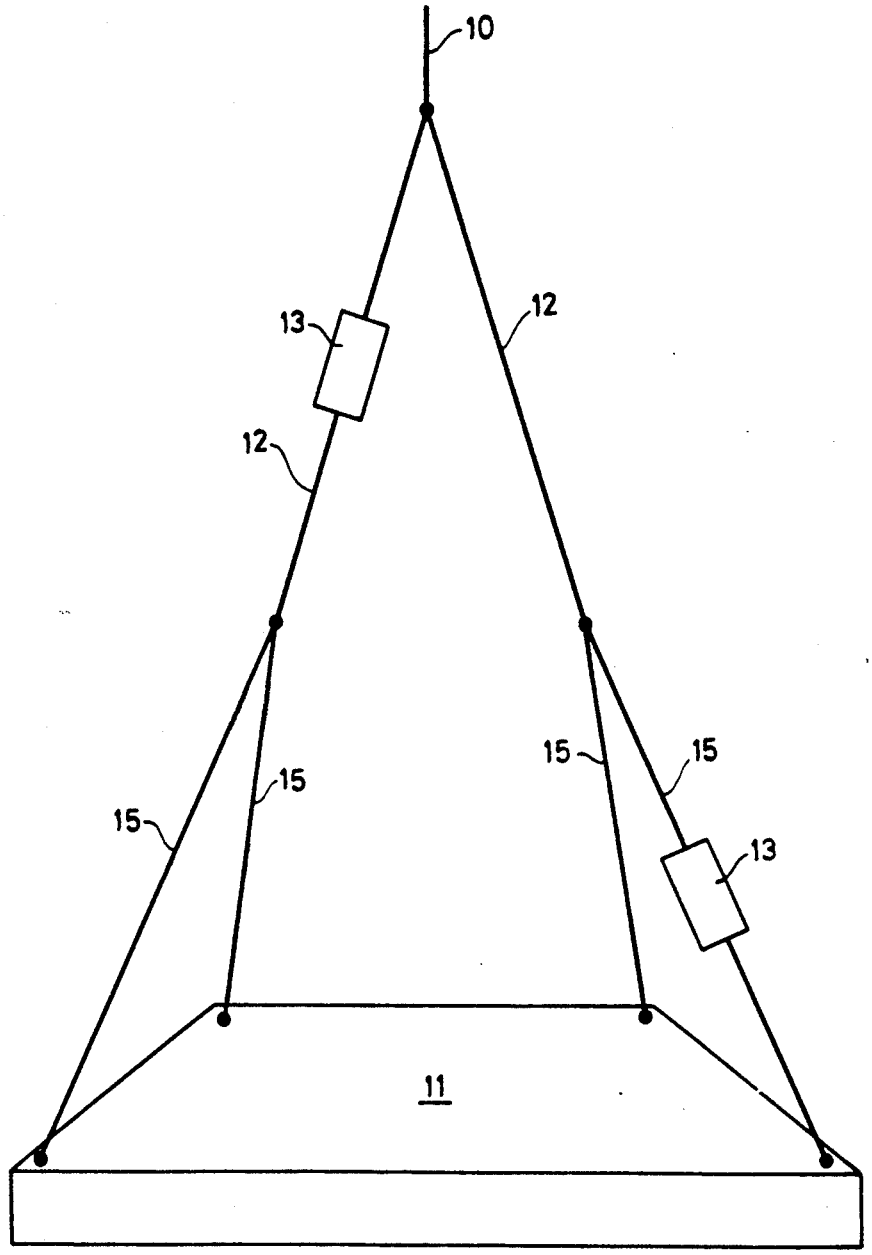
FIG. 3 shows diagrammatically a system in which several lifting and positioning gears according to the invention are used and, FIG. 4 shows diagrammatically another system in which several lifting and positioning gears are also incorporated.

FIG. 3 shows a use in which the load 11 has an appreciable surface area. The diagrammatically shown hoisting cable 10 divides up into two suspension cables 12 which divide up in turn into follow-on suspension cables 15. Lifting and positioning gear 13 according to the invention is located in one of the suspension cables 12 and in one of the follow-on suspension cables 15. This makes a more accurate positioning of the load 11 possible. Said lifting and positioning gears may each be connected separately to control devices 30, but they may also be connected to common control devices 30 so that one operator is able to operate the two lifting and positioning gears 13 together.

It is clear that several lifting and positioning gears according to the invention may be connected both in series and in parallel.

Figure 4:
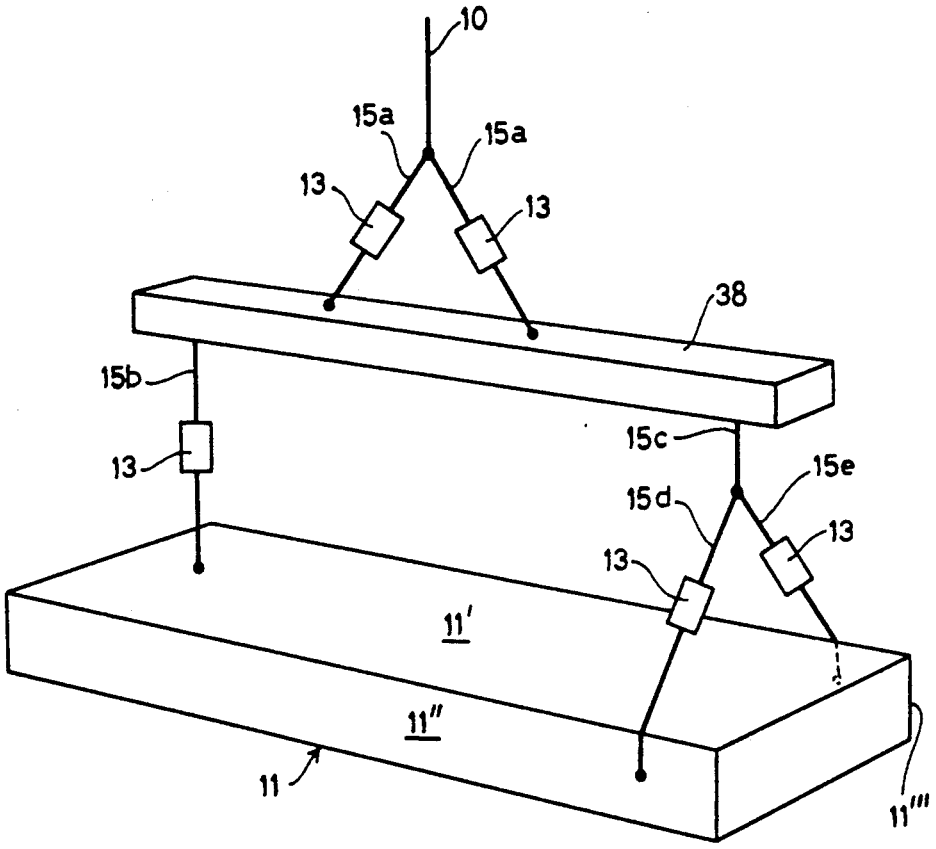

FIG. 4 finally shows yet another embodiment in which a hoisting cable 10 divides up into two follow-on cables 15*a* which support a supporting beam 38. In each of the follow-on cables 15*a*, positioning gear according to the invention is incorporated.

In order to be able also to rotate the load 11, the supporting beam 38 is connected via a follow-on cable 15*b* and positioning gear 13 incorporated therein to an upper face 11′ of the load 11. At the other end of the beam 38, another follow-on cable 15*c* is fitted which divides up into two cables 15*d*, 15*e* which are connected to side faces 11″ and 11‴. Positioning gears 13 are also incorporated in the cables 15*d* and 15*e*.

What is claimed is:

1. Positioning device adapted to be incorporated as a controllable coupling element between a load and a hoisting cable of a crane, said coupling element comprising a hydraulic cylinder;

a single acting piston movably mounted within said cylinder and having a rod protruding out of one end of said cylinder, the space in said cylinder existing between said piston and said one end of said cylinder varying as said piston is moved, said cylinder having an opening communicating with said space for the supply and the discharge of a pressurized hydraulic fluid;

means for connecting said cylinder to said hoisting cable, means for connecting said rod to a load so that said load can be raised or lowered relative to said hoisting cable;

a first hydraulic conduit with first and second ends and coupled at one of its said ends to said cylinder opening;

a hydro-pneumatic transformer coupled to the other end of said first hydraulic conduit;

gas coupling lines;

a source of pressurized gas coupled to said transformer through said gas coupling lines, a first controllable valve arranged in said gas coupling lines between said source and said transformer, said valve being movable to a first position for allowing gas to flow from said gas source to said transformer for raising said load, and a second position for shutting off said gas flow from said source, said valve also being movable to a third position for venting the hydro-pneumatic transformer to the atmosphere;

a second hydraulic conduit having a first end coupled to said first hydraulic conduit and having a second end;

a hydro-pneumatic reservoir coupled to said second end of said second hydraulic conduit;

a second controllable valve arranged in said second hydraulic conduit, said second valve being movable between an open position for permitting fluid flow in said second conduit and a closed position for preventing fluid flow in said second conduit; and means for controlling said first and second valves.

2. The positioning device of claim 1 wherein said means for controlling said valves includes at least one control device for remotely operating said valves.

* * * * *